United States Patent [19]

Andrews

[11] Patent Number: 4,474,299

[45] Date of Patent: Oct. 2, 1984

[54] DISPLAY FITTINGS

[76] Inventor: Raymond B. Andrews, 9 Lakeside Crescent, North Manly, New South Wales, Australia, 2100

[21] Appl. No.: 364,602

[22] Filed: Apr. 1, 1982

[51] Int. Cl.[3] ..... A47F 7/19

[52] U.S. Cl. ..... 211/193; 211/123; 211/182

[58] Field of Search ..... 211/193, 208, 182, 123, 211/204, 183, 105.1

[56] References Cited

U.S. PATENT DOCUMENTS

| | | | |
|---|---|---|---|
| 2,428,282 | 2/1969 | Pernice | 211/123 X |
| 2,868,389 | 1/1959 | Friend | 211/123 |
| 3,960,275 | 6/1976 | Haughton et al. | 211/182 |
| 4,253,578 | 3/1981 | Rekow | 211/208 |
| 4,316,547 | 2/1982 | Varon | 211/105.1 |
| 4,361,241 | 11/1982 | Stoddard | 211/123 |
| 4,380,298 | 4/1983 | Harig | 211/204 X |

FOREIGN PATENT DOCUMENTS

| | | | |
|---|---|---|---|
| 2313712 | 9/1974 | Fed. Rep. of Germany | 211/123 |
| 2296389 | 7/1976 | France | 211/193 |
| 11754 | of 1909 | United Kingdom | 211/182 |

*Primary Examiner*—Ramon S. Britts
*Assistant Examiner*—Robert W. Gibson, Jr.
*Attorney, Agent, or Firm*—Hubbell, Cohen, Stiefel & Gross

[57] ABSTRACT

A merchandise support assembly consists of firstly a coupling with two siamesed sockets, one for engaging the vertical column of a display stand, the other being directed obliquely downwards, and an integral hook for the alternative support of the coupling, such hook being adapted to engage a horizontal rail or rails; secondly, a bar which is supported by the oblique socket and thirdly, a set of sleeves each capable of being slid and to end over the bar. The sleeves each have lugs which form a spaced series for determining the spacing between clothers-hangers or other display aids.

9 Claims, 3 Drawing Figures

FIG. 2
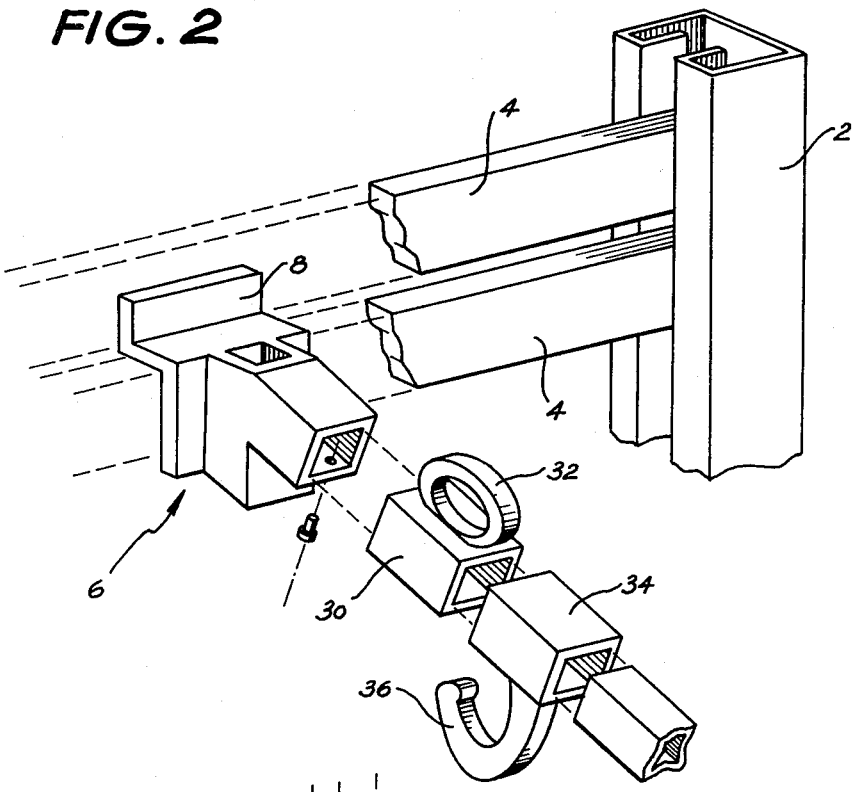
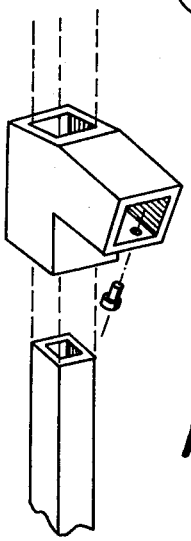
FIG. 3

DISPLAY FITTINGS

FIELD OF THE INVENTION

This invention concerns display stands for clothing and particularly support brackets for face-out merchandising.

BACKGROUND OF THE INVENTION

Face-out display of garments requires the use of stout horizontal wooden rails mounted on pairs of vertical wall mounted stiles which act as racks and metal brackets which engage the rails at the upper end while pointing obliquely downwards. Each bracket has a row of metal studs projecting from the upper region thereof which act as arresters for clothes hangers which in turn support the garments. By virtue of the slope of the brackets, a portion of each garment is seen by a customer and that part is usually the collar region or in slacks, enough of the garment leg may be displayed to give a good idea of the pattern or weave without the need for removing the same from the stand. One known metal bracket referred to above in more general terms is manufactured entirely by metal working processes and its appearance is rendered somewhat more acceptable by chromeplating. Even so, unsightly welds are often visible and the appearance is generally that of an engineering product rather than a shop display fitting.

This invention seeks to simplify the manufacture of such brackets and improve their appearance.

SUMMARY OF THE INVENTION

This invention provides merchandise support assembly comprising an arm which has means at one end to releasably engage a rack and to direct the arm downwardly at a suitable oblique angle for face-out display of the merchandise and a plurality of sleeves threaded onto and retained on the arm, each sleeve having at least one merchandise locator in order to impose a preselected mutually spaced disposition to the merchandise.

The locator may be a peg, hook, ring or clip. The sleeve may be a sliding fit on the arm and both may be of a cross-section which prevents rotation of the sleeve on the arm. The sleeve may be of modified C-section and each sleeve may be a moulding and may have a pair of integrally moulded lugs, the ends of the sleeve projecting beyond the sites of the lugs such that when a series of sleeves are threaded onto the arm a row of equally spaced lugs results.

This invention also provides a coupling intended for use as part of a merchandise support assembly comprising a main tubular section intended for coaxial sliding engagement with an upright member of a display fixture, a branch tubular section intersecting the main tubular section along a mid-axis of the main tubular section, the branch being directed downwardly at an oblique angle to the longitudinal axis of the main tubular section for receiving and supporting a rigid arm forming part of the display fixture and a hook section integral with the main tubular section, disposed opposite the branch tubular section, transversely of said mid-axis for optionally engaging a horizontal rail of the display fixture.

The branch tubular section which functions as a socket of rectangular cross-section may intersect the main tubular section at or near one end of the latter and the joint between the two sections may be braced by a gusset. The main tubular section may have a rectangular cross-section. The hook section may include a front surface extending perpendicular to said mid-axis for abutting one face of the fixture rail, a rear surface for abutting the opposite face of the fixture rail and a top part bridging the two surfaces, the arrangement being that the hook section overlies the rail and engages the same to an extent determined by the top part. The main tubular section and branch section may be of square cross-section and the front plate may form one wall of the main tubular section. The coupling may be a one piece injection moulding of plastic material.

DESCRIPTION OF DRAWINGS

Various embodiments of the invention are now described by way of example with reference to the accompanying drawings wherein

FIG. 2 is an exploded view of an alternative assembly showing ringed sleeve and a reversed hook sleeve;

FIG. 3 is an exploded perspective view of a modified form of the coupling.

Figure 1:
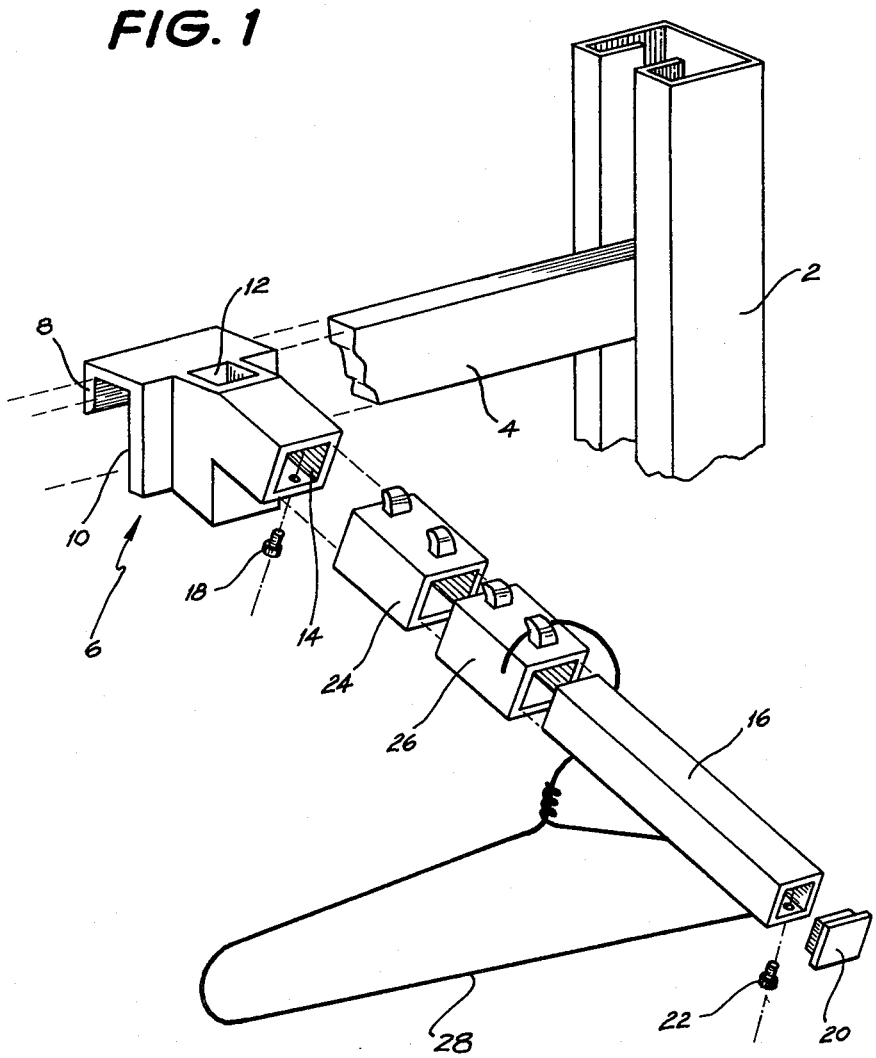
FIG. 1 is an exploded perspective view of the preferred embodiment.

A steel column 2 of channel-section supports a horizontal enamelled steel rail 4. A coupling 6 moulded in polycarbonate engages the rail with a hook section 8 and a reaction surface 10. An integral, square, vertical, open-ended main tubular section 12 projects forwardly on the surface 10 and is siamesed with a forwardly and downwardly projecting branch socket 14. The square section hollow bar 16 is retained in the socket by said screw 18 and closed by a cap 20 again secured by said screw 22. Four sleeves 24, 26 (only two shown) moulded in acetal resin each having two hooks for supporting a clothes hanger 28 at equal intervals along the bar. In this way the bracket may be assembled so that no metal is visible. By "rack" is meant a freestanding or wall mounted frame or a stand which is used to display goods. It may have a rail or rails which are engaged by the hooks of the couplings. It may have one or more vertical tubes over which the couplings may be threaded. The rack may be specially built for face out display in which case it will be provided with both tubes and rails.

Whereas in the above embodiment the coupling is separable from the arm, in another embodiment the coupling is made of metal and is integral with the arm. Referring now to FIG. 2, the hook section 8 fits between twin rails 4. Sleeve 30 has a moulded ring 32. Sleeve 34 has a reverse hook 36. Referring now to FIG. 3, a square column 38 receives coupling 6 as a cap and supports a bar in the same way as the other embodiments.

I claim:

1. In a merchandise support assembly including a rail, a display arm comprising:

(a) a coupling including a connector section for releasable connection to said rail and a hollow socket extending transversely of said connector section, (b) an elongated bar having one end slidably disposed in said socket and being cantilevered outwardly therefrom;

(c) a removable securing element releasably securing said one end of said bar in said socket, (d) a plurality of sleeves slidably disposed on said bar in end to end relation, each of said sleeves including at least one merchandise locator for releasably engaging merchandise holding means and for holding said merchandise holding means in spaced disposition relative to one another;

(e) a stop means mounted on the other end of said bar for preventing sliding disengagement of said sleeves from said bar at said other end; and (f) a removable securing element releasably securing said stop means on said other end of said bar.

2. The coupling of claim 1, wherein said bar extends obliquely downwardly when said coupling is releasably connected to said rail.

3. The coupling of claim 2, wherein said plurality of sleeves is equal in length to the portion of said elongated bar between said socket and said stop means.

4. The coupling of claim 2, wherein said merchandise holder is a peg, hook, ring or clip.

5. The coupling of claim 2, wherein said socket, bar and sleeves are all non-circular to prevent relative rotation therebetween.

6. The coupling of claim 2, wherein said connector section is a C-shaped hook for releasable connection to said rail.

7. The coupling of claim 2, wherein said rail in said merchandise support assembly is horizontal, and said merchandise support assembly includes a second rail in spaced parallel relation with said first mentioned rail, and said connector is an offset upstanding hook disposable between said rails.

8. The coupling of claim 2, wherein said rail in said merchandise support assembly is vertical, and said connector section is a hollow member slidably disposable on said vertical rail.

9. The coupling of claim 5, wherein said plurality of sleeves is equal in length to the portion of said elongated bar between said socket and said stop means.

* * * * *